United States Patent [19]

Drumm

[11] Patent Number: 4,512,275

[45] Date of Patent: Apr. 23, 1985

[54] UNSINKABLE ALL-PURPOSE BOAT

[76] Inventor: Philip R. Drumm, P.O. Box 608, Midtown, New York, N.Y. 10018

[21] Appl. No.: 489,102

[22] Filed: Apr. 27, 1983

[51] Int. Cl.[3] ..... B63B 5/24; B63B 35/72

[52] U.S. Cl. ..... 114/39; 114/61; 114/343; 114/357; 114/363

[58] Field of Search ..... 114/39, 61, 354, 363, 114/347, 343, 43, 357

[56] References Cited

U.S. PATENT DOCUMENTS

| | | | |
|---|---|---|---|
| 828,072 | 8/1906 | Tenneson | 114/363 |
| 3,383,720 | 5/1968 | Greig et al. | 114/39 X |
| 3,497,887 | 3/1970 | Bureau, Jr. | 114/357 |
| 3,790,977 | 2/1974 | Bombardier et al. | 114/357 |
| 3,958,289 | 5/1976 | Carlson | 114/363 X |
| 4,266,707 | 5/1981 | Rossman | 114/363 |

FOREIGN PATENT DOCUMENTS

| | | | |
|---|---|---|---|
| 2352908 | 4/1975 | Fed. Rep. of Germany | 114/39 |

*Primary Examiner*—Sherman D. Basinger

[57] ABSTRACT

This all-purpose boat is designed for pleasure or survival, and may be used in salt, fresh, or chlorinated water, and may also be adapted for use on ice and snow, and may be further adapted for use on dry land, by the employment of wheels. Primarily, it consists of a hull fabricated of a polyethylene foam, which is provided with cut-out slots for frictionally receiving a front cowl and storage unit, a mast and sail plate, a seat, and a storage chest. It further includes a detachable outrigger unit, and a fore and aft stabilizer.

1 Claim, 21 Drawing Figures

UNSINKABLE ALL-PURPOSE BOAT

This invention relates to water craft combinations, and more particularly, to an unsinkable all-purpose boat.

The principal object of this invention is to provide an unsinkable all-purpose boat, which will be used in fresh water and salt water, and may also be employed upon land and upon ice and snow.

Another object of this invention is to provide an unsinkable all-purpose boat, which will be fabricated of resilient polyethylene floation foam, so as to float indefinitely, even if punctured or slashed, and it will also be virtually impossible to stove-in, unless crushed between two boats, etc.

Another object of this invention is to provide an unsinkable all-purpose boat, which when pushed beneath the water, the greater its bouyancy, until it will collapse at enormous depth pressure.

Another object of this invention is to provide an unsinkable all-purpose boat, which will resist battering, punctures, rocks, barnacles, and gravel and it will also resist oil, chemicals, salt sea, and pool chloride.

Another object of this invention is to provide an unsinkable all-purpose boat, which will require no maintenance, such as painting, will not corrode, and will need no oiling or polishing, and its color will be dyed in, so as to permanently last.

A further object of this invention is to provide an unsinkable all-purpose boat, which will be very light in weight, may be gripped from any angle, will throw like a large life ring, will rise to meet head seas, following seas, cross-swells, will bob on choppy seas, rise through breaking seas, ride surf, and will be very stable when its occupants sit, stand, lie down, or lean over the side.

A still further object of this invention is to provide an unsinkable all-purpose boat, which will be quickly and easily righted by a swimmer, can be flipped back upright, and will be hand propelled, paddled, or may employ outboard motor power, or sail.

As even further object of this invention is to provide an unsinkable all-purpose boat, which will be easy to ship, because it will require no packaging, other than a plastic envelope, which it will be sold in.

other objects of the invention are to provide an unsinkable all-purpose boat, which will be simple in design, inexpensive to manufacture, rugged in construction, and easy to use.

These and other objects will become readily evident, upon a study of the specification, and the accompanying drawings, in which.

Figure 1:
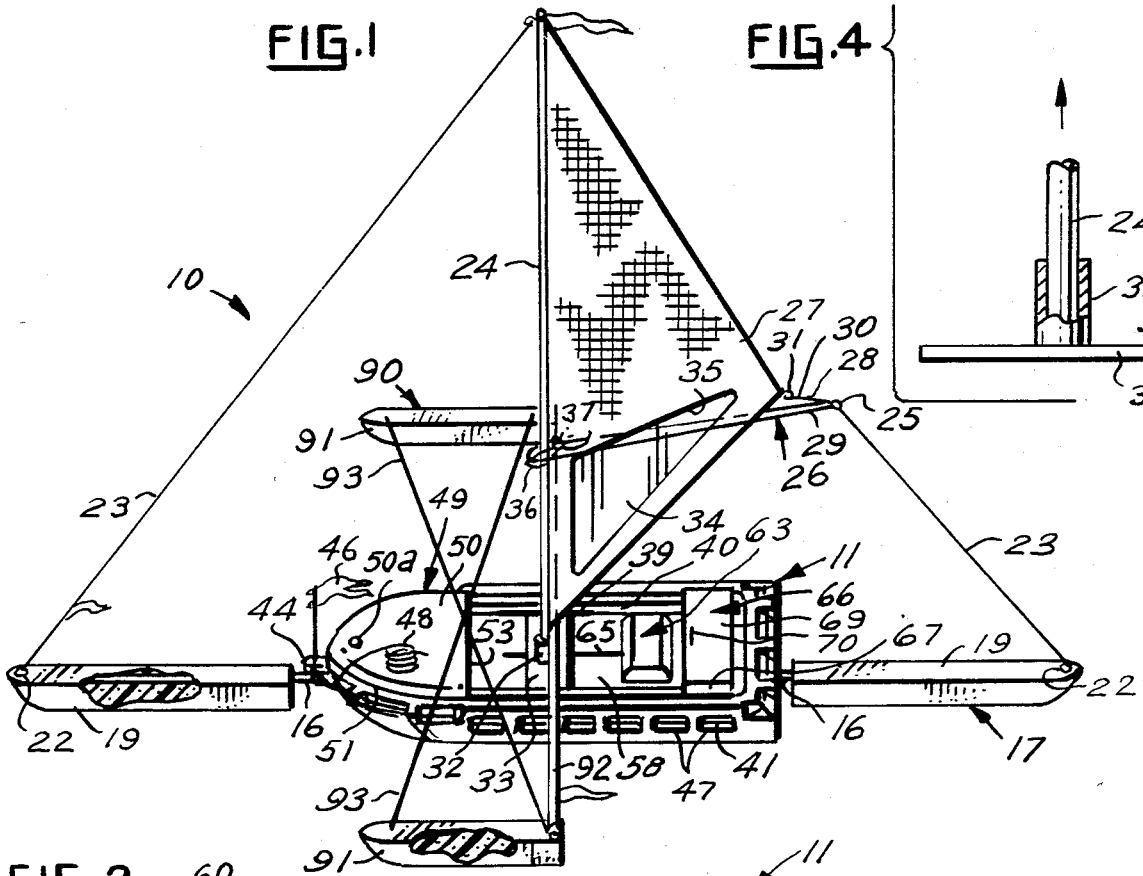
FIG. 1 is a perspective view of the present invention, shown partly in section, and illustrating the side float member unsecured for the sake of clarity.
Figure 4:
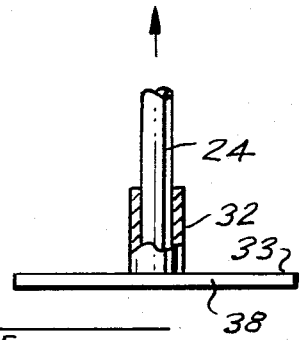
FIG. 4 is an enlarged side view of the mast mounting member, shown in elevation, and partly in section, with the mast shown fragmentary.
Figure 2:
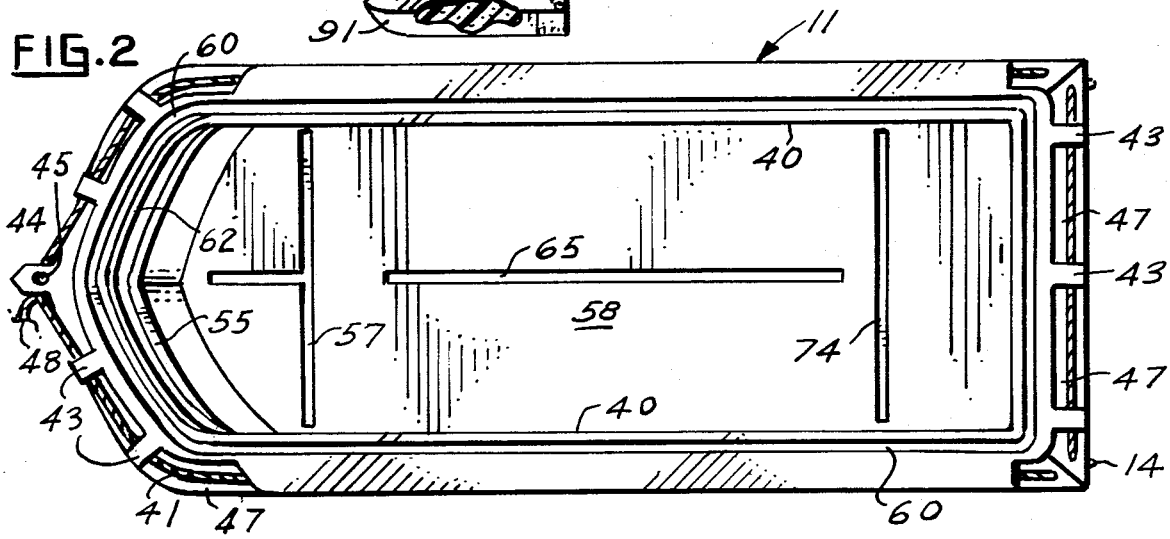
FIG. 2 is an enlarged top plan view of the hull, showing all of the conponent parts removed therefrom, with the exception of the gun-wale rope, for the sake of clarity.
Figure 3:
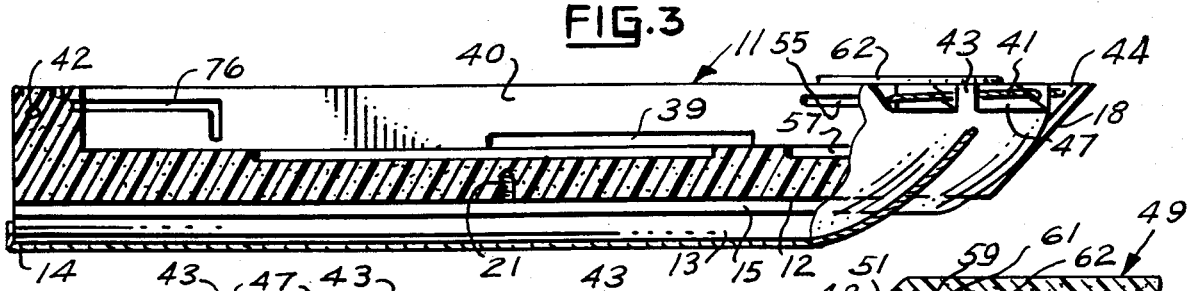
FIG. 3 is a side view of FIG. 2, shown in elevation and partly in section.
Figure 5:
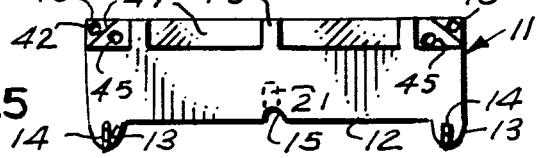
FIG. 5 is a rear end view of FIG. 2, shown in elevation, with the rope removed therefrom, and is illustrated on a slightly smaller scale.
Figure 6:
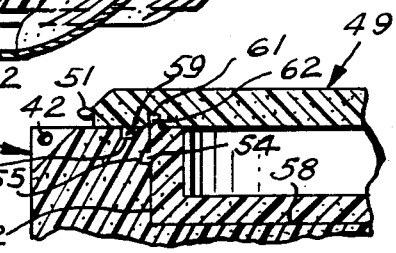
FIG. 6 is an enlarged and fragmentary bow end view of the hull of the invention, shown in elevation and section, and illustrates the mounting of the front cowl and compartment combination.
Figures 7, 8, 9, 10, 11, 12, 13, 14, 15, 16, 17, 18, 19, 20, 21:
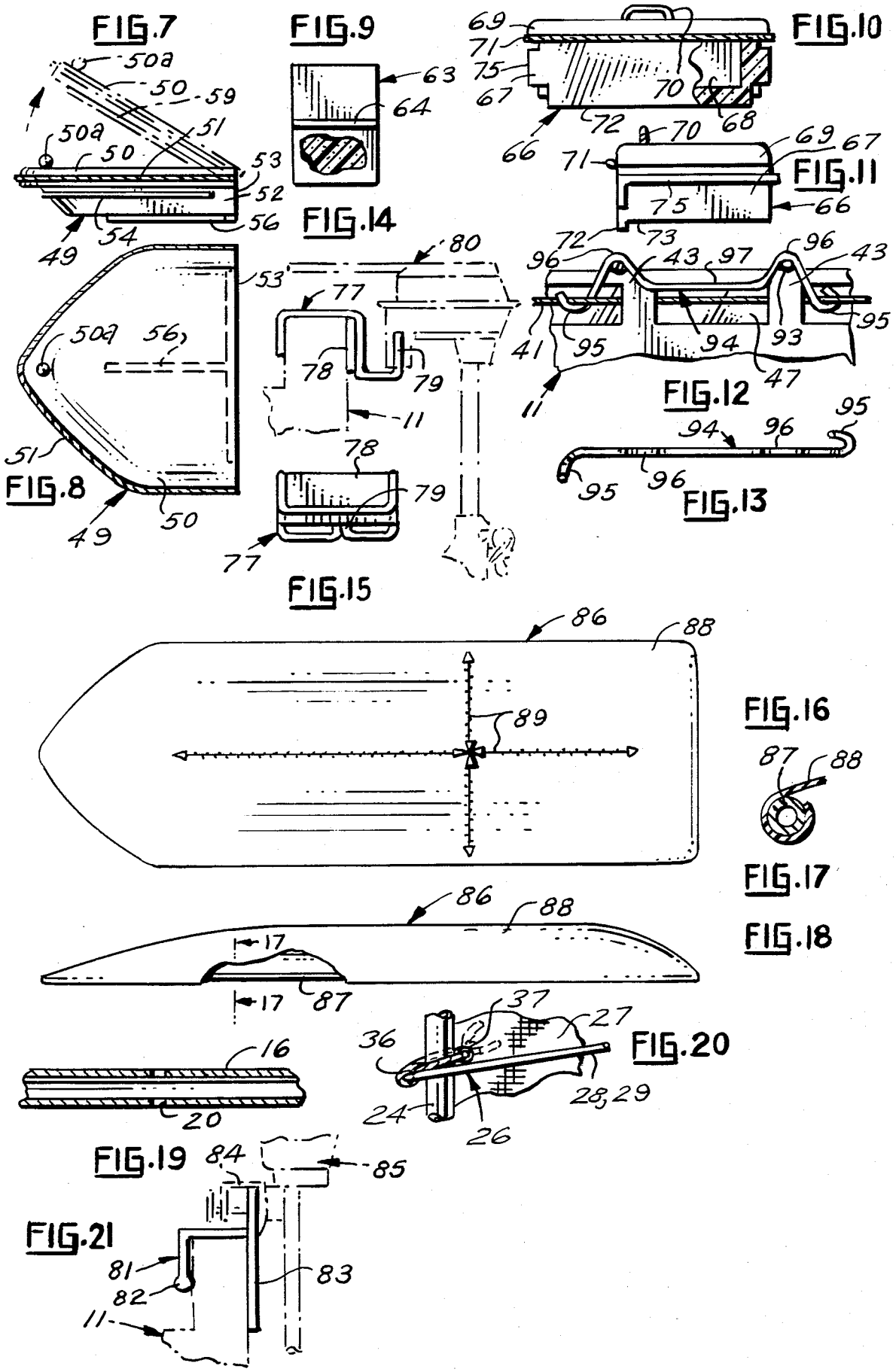
FIG. 7 is a side view of the front cowl and storage compartment unit, shown in elevation and removed from the hull of the invention, and illustrates the open condition of the top cover, in phantom.
FIG. 8 is a top plan view of FIG. 7.
FIG. 9 is a bottom plan view of the seat member of the invention, shown partly in section, and removed therefrom.
FIG. 10 is a front end view of the rear storage chest, shown in elevation and partly in section.
FIG. 11 is a side view of FIG. 10, shown in elevation.
FIG. 12 is a enlarged fragmentary side view of the hull, shown in elevation, and illustrating one of the mounting bar hook members, retaining one side of the lateral outrigger member to the top of the hull.
FIG. 13 is a top plan view of the hook member, shown removed from FIG. 12.
FIG. 14 is a side view of an engine mounting bracket, engaging with an engine, the hull being shown fragmentary, in elevation, and in phantom, and the engine is also illustrated in phantom.
FIG. 15 is a front view of FIG. 14 shown in elevation, with the engine removed therefrom.
FIG. 16 is a top plan view of a removable cover for the hull of the invention, which is used when the hull is utilized as a kayak.
FIG. 17 is an enlarged cross-sectional view, taken along the line 17—17 of FIG. 18.
FIG. 18 is a side view of FIG. 16, shown in elevation and partly broken away.
FIG. 19 is an enlarged fragmentary side view of the longitudinal stabilizer floatation member, shown in elevation and in section.
FIG. 20 is an enlarged fragmentary side view of the mast, sail, and boom of the invention, shown in elevation.
FIG. 21 is a side view of a second engine mounting bracket, for use with a clamp mounted engine, which is shown fragmentary and in phantom, and the hull is shown in elevation, and also in phantom.

Accordingly, a boat 10 is shown to include a hull 11, fabricated of suitable foam plastic material. The bottom surface 12 is substantially flat, and is terminated on both longitudinal side edges, by a rounded runner portion 13, which includes a plastic rope 14, embedded therein, longitudinally, and extending partially therefrom. A semi-circular groove 15, is centrally disposed, and extends longitudinally front the front of surface 12, to its rear, so as to removably receive a pipe member 16 of a fore and aft stabilizer 17, which hereinafter will be described. The pair of runner portions 13, are integrally formed of hull 11, and their forward ends, are staggered behind the bow 18 of hull 11, which is centrally disposed thereof. The runner portions 13, serve as longitudinal stabilizer means for hull 11, when it is moved in the water under sail or other power, and the runner portions 13, also serve as runners on the surface of ice and snow, when hull 11 is used for such a purpose.

The fore and aft stabilizer 17, consists of a pontoon of float 19, which is pointed at one end, and floats 19, are oppositely opposed to each other, and are fixedly secured to the ends of pipe 16, in a suitable manner, not shown. Floats 19 are fabricated of a suitable foam plastic, similar to that of hull 11, and the stabilizer 17 is secured to hull 11, by a suitable fastener, not shown, which is received in the transverse opening 20 of pipe 16, and is threadably received in opening 21 in bottom surface 12 of hull 11. The groove 15 of surface 12, serves to retain pipe 16 in alignment, and the floats 19, being fore and aft, serve to provide longitudinal stability for hull 11, against pitch, and further serves as auxiliary protection against head seas, following seas, and cross-swells. Floats 19 include an attached eye 22 in its top surface, which is secured to a line 23. One of the lines 23 is secured at its opposite end, to the top of mast 24, and the opposite end of the other line 23, is suitably secured to an eye 25, which is fixedly secured to boom 26. Boom 26, is of a rod type, and sail 27 is freely received within the confines of its legs 28 and 29. A line 30, is also secured to eye 25, and to eye 31 of the corner of sail 27, and sail 27 is secured to mast 24, in a manner, not shown. The bottom of mast 24, is removably received in a sleeve 32, which is fixedly secured to a rectangular metal plate 33, and clear plastic panel 34, is fixedly secured in opening 35, through the bottom portion of sail 27, so as to enable the user to see therethrough, when hull 11 is used on ice, or upon the ground surface. The closed end of boom 26, is free on the outer periphery of mast 26, and is secured to sail 27 by a rope 36, which is received in opening 37, and tied.

The peripheral side edges 38 of plate 33, are frictionally received in a pair of cut-out slots 39 in the inside surfaces 40 of hull 11, so as to support mast 24 and its sail 27, and a suitable plastic rope 41 entends around hull 11, and is received through openings 42 of projections 43, bow projection 44, and openings 45 of the hull 11, so as to provide a means of easily launching hull 11, and rope 41, serves as hold-on means for persons in the water, and further serves as retaining means for accessories, which hereinafter will be described. Bow projection 44, also includes a top opening 45, for removably receiving flag 46, and the recessed areas 47, enables easy gripping of rope 41, by one's hands, or accessories. A line 48, is also fastened to bow projection 44, and a cowl and storage unit 49 is removably received in the bow portion of hull 11. Storage unit 49 includes a hingeable cover 50, having a handle grip 50*a*, which is fixedly secured thereto, in a suitable manner, not shown. A length of decorative rope 51 is suitably attached to the outer peripheral surface of cover 50, and the cover 50, is integrally attached to the body 52 of unit 49, at its rear wall 53. A rib 54 extends from, and is integrally attached to the outer peripheral surface of body 52, and is frictionally received within arcuate groove 55, within the bow portion of hull 11. A "T"-shaped configurated rib 56, is integrally attached to the bottom surface of body 52, and is frictionally received within a similarly shaped groove 57, in the floor surface 58 on the interior of hull 11. An arcuate rib 59 on the bottom of cover 50, is frictionally received in the arcuate portion of continuous groove 60 in the top of hull 11, and the combination above described, serve to render unit 49 and its cover 50, secure, and closed in the bow portion of hull 11. An arcuate groove 61 in the underside cover 50, frictionally receives an arcuate rib 62, which is integral with, and extending upward from the bow portion of hull 11, and 61 and 62, serve to further secure cover 50 closed.

A seat 63 is fabricated of foam plastic, and is solid in configuration, and includes a rib 64 on its underside, which is frictional received in groove 65 in floor surface 58 of hull 11. The groove 65 is of such length, as to enable seat 53 to be positioned in any desired position, fore and aft.

A storage chest 66 is provided, and includes a foam plastic body 67, with a compartment 68 for storage of various articles, such as refrigerated items, etc. A cover 69 with a rope handle 70, is hingeably, and integrally attached to body 67, and a length of rope 71 is suitably secured to the front of cover 69, for decoration. A rib 72 extends from, and is integrally attached to the bottom wall 73, and is frictionally received in slot 74 in floor surface 58 of hull 11. A "V"-shaped configurated rib 75 on three sides of chest 66, is frictionally received in a similar shaped slot 76 on the inside surfaces 40 of hull 11, and the transom thereof, and the combination of ribs 72 and 75, and their associated slots 74 and 76, provide retaining means for storage chest 66.

An outboard mounting bracket 77 of tubular metal, is shown to include a plate 78, which bears against the outside of hull 11, and one end of bracket 77 engages over the gun-wale of hull 11, and its opposite hook end 79, is received within the bottom of outboard engine 80. A second outboard mounting bracket 81, includes a beaded edge 82, and a plate 83, the plate 83 engaging the outside of hull 11, and the beaded edge 82, engaging the inside surface 40 of hull 11. The plate 83, which is fixedly secured to bracket 81, extends upwards to receive the clamps 84 of the outboard engine 85.

When hull 11 is used as a kayak, a cover 86 is used, and consists of a frame 87 of tubular construction, which is frictionally received within groove 60 of hull 11, and frame 87 is covered with a suitable plastic material 88, which is fastened at its edges, to frame 87. A plurality of zippers 89 in material 88, enables the user to cover himself, while his upper body projects from the cover 86.

An outrigger unit 90 is shown to include a pair of floats 91, which are fixedly secured to a pipe 92 at its ends. A pair criss-crossed rods 93 are fixedly secured to the tops of floats 91, which are of foam plastic, and a rope not shown, is secured to each end of pipe 92, and is secured at its opposite end, to the top of masts 24, so as to provide for maximum strength in securing outrigger unit 90 to hull 11. A pair of hook rods 94, which are not shown in FIG. 1 of the drawing, for the sake of clarity, include a hook 95 at each end, and each hook 95 is oppositely opposed to each other, so as to hookingly engage rope 41. A pair of recessed portions 96, formed in the main body 97 of rods 94, serve to engage the rods 93 of outrigger unit 90, so as to hold them secure to the tops of the gun-wales of hull 11.

In use, boat 10 when used for sea, has the outrigger unit 90 attached thereto, by the hook rods 94 and the ropes of floats 91, not shown, The fore and aft stabilizer 17, is also attached to the hull 11 by a suitable fastener, received in the opening 20 of its pipe 16, and the opening 21 in hull 11. The lines 23 of the floats 19, are then secured to the top of the mast 24, after it is placed in the sleeve 32 of plate 33, which has been frictionally received in the slots 39 of hull 11. The mounting brackets 77 or 81 may also be placed over the gun-wales whichever is desired, so as to have auxiliary power for hull 11, by employing either their respective outboard engines 80, or 85. When fishing all of the abovementioned components may be removed, and the use of paddles, not shown, or the engines 80 or 85 may be employed for power.

When the hull is used as a surfer, the sail may be used, and controlled by its user, and when used on ice, the outrigger unit 90 and the sail 27 may be employed, without the fore and aft stabilizer attached.

It shall be noted, that boat 10 is easily rightable, easily steered, and may be employed for survival, and is easily launched by one person, because of its lightness in weight, and two may be attached together easily, by the rope 41 means, back to back. or side to side.

It shall also be noted, that boat 10 may also employ air propeller drive, which is easily attached, and wheels may also be attached in a suitable manner, so as to enable its use upon the ground, particularly, by sail 27 power.

While various changes may be made in the detail construction, such changes will be within the spirit and scope of the present invention, as defined by the appended claims.

I claim:

1. An unsinkable all-purpose boat, comprises, in combination, a resilient foam plastic hull, a resilient foam plastic cowl and storage unit frictionally received in said resilient foam plastic hull, a resilient foam plastic seat frictionally received in said resilient foam plastic hull, and a resilient foam plastic storage chest frictionally received in said resilient foam plastic hull, and a plate is removably received in said resilient foam plastic hull and provides support means for a mast and is rectangular in configuration, and one end of a hollow cylindrical sleeve is fixedly secured to one side of said plate in a suitable manner, and said hollow cylindrical sleeve removably receives the bottom end of said mast, and the ends of said plate are frictionally received in a pair of elongated cut-out grooves in the inside surfaces of the side walls of said resilient foam plastic hull, and a fore and aft stabilizer is provided and includes a tube which extends from the bow portion and the transom, and is removably secured in a longitudinal groove provided in the bottom surface of said resilient foam plastic hull, by suitable means, and the ends of said tube are fixedly secured in a resilient foam plastic float in a suitable manner.

* * * * *